US008468689B2

(12) United States Patent
Spruell et al.

(10) Patent No.: US 8,468,689 B2
(45) Date of Patent: Jun. 25, 2013

(54) METHOD OF PRODUCING A MULTI-ELEMENT ASSEMBLY

(75) Inventors: Stephen L. Spruell, Carrollton, GA (US); Wilber F. Powers, Newnan, GA (US); Scott Robertson, Newnan, GA (US)

(73) Assignee: Southwire Company, Carrollton, GA (US)

( * ) Notice: Subject to any disclaimer, the term of this patent is extended or adjusted under 35 U.S.C. 154(b) by 1044 days.

(21) Appl. No.: 12/477,941

(22) Filed: Jun. 4, 2009

(65) Prior Publication Data

US 2009/0242228 A1 Oct. 1, 2009

Related U.S. Application Data

(62) Division of application No. 11/853,429, filed on Sep. 11, 2007, now abandoned.

(51) Int. Cl.
*H01R 43/00* (2006.01)

(52) U.S. Cl.
USPC ..... 29/825; 29/858; 57/13; 57/293; 57/295; 57/296

(58) Field of Classification Search
USPC ..... 29/825, 858; 57/13, 293, 295, 296
See application file for complete search history.

(56) References Cited

U.S. PATENT DOCUMENTS

| | | | | |
|---|---|---|---|---|
| 5,767,441 | A * | 6/1998 | Brorein et al. | 174/27 |
| 6,101,804 | A * | 8/2000 | Gentry et al. | 57/296 |
| 6,430,913 | B1 * | 8/2002 | Gentry et al. | 57/314 |
| 6,526,738 | B2 * | 3/2003 | Gentry et al. | 57/7 |

OTHER PUBLICATIONS

Mexican Office Action dated Sep. 14, 2011 cited in Application No. MX/A/2009/002568.
Mexican Office Action dated Mar. 7, 2011 cited in Application No. MX/a/2009/002568.
U.S. Office Action dated Dec. 11, 2008 cited in U.S. Appl. No. 11/853,429.
Mexican Office Action dated Nov. 27, 2012 cited in Application No. MX/a/2012/006114, 4 pgs.

* cited by examiner

*Primary Examiner* — Carl Arbes
(74) *Attorney, Agent, or Firm* — Merchant & Gould

(57) ABSTRACT

A plurality of individual elements are imparted with reverse axial twist and collectively twisted into a multi-element assembly. Each individual element has an axial twist direction in an opposite direction from the axial twist direction of the collective multi-element assembly. The reverse axial torsion in the assembly tightly binds the plurality elements in the assembly to resist separation.

17 Claims, 6 Drawing Sheets

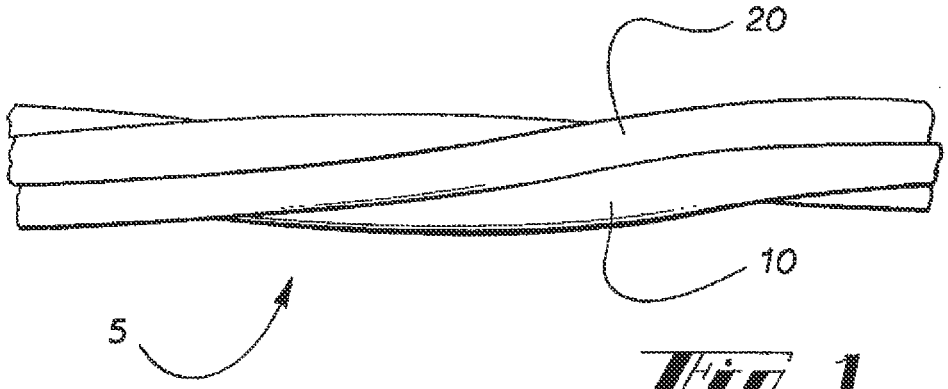
Fig. 1
Fig. 7
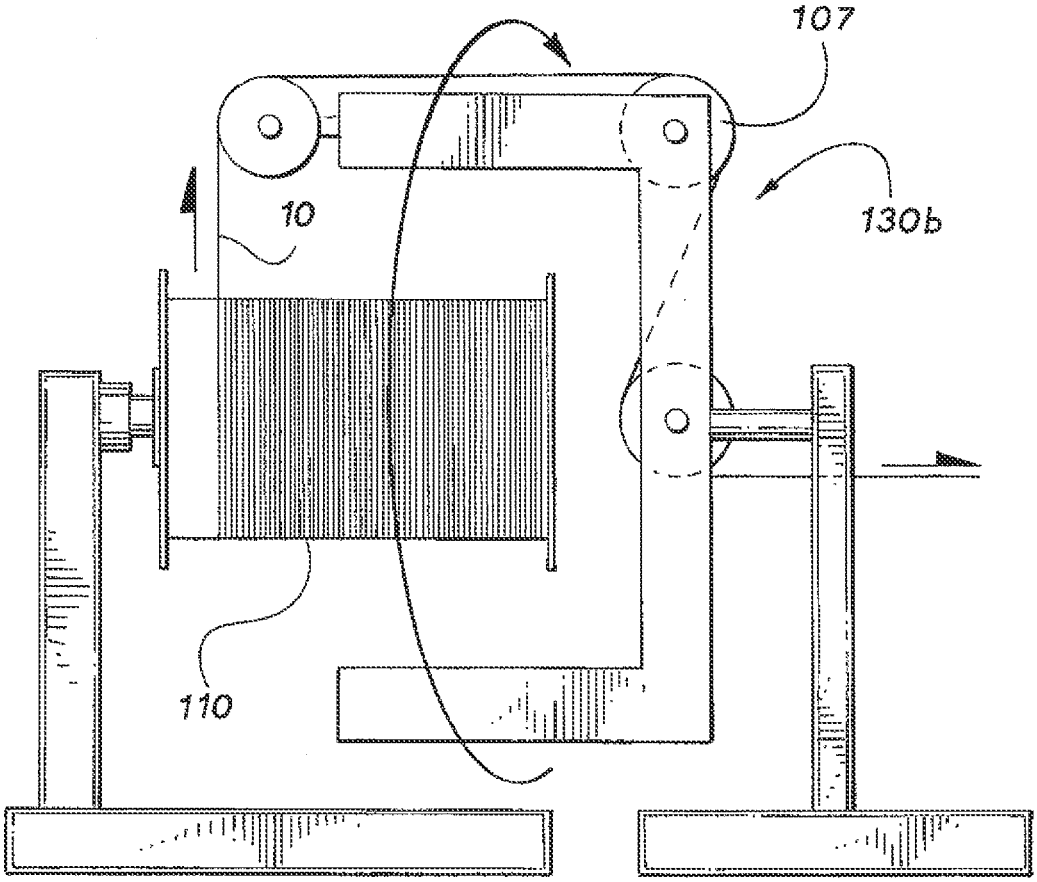

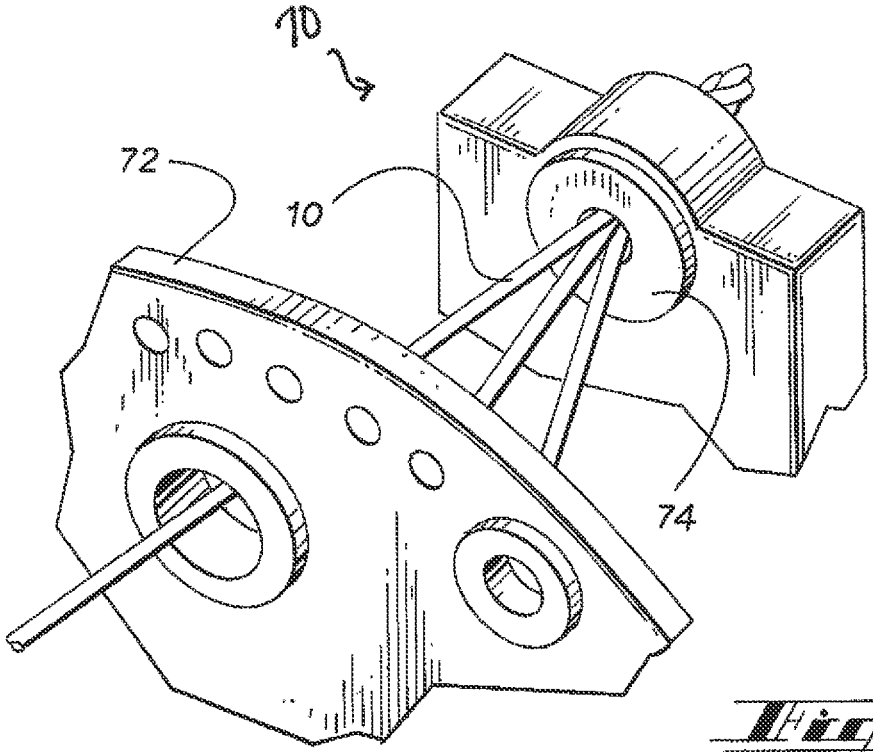
Fig. 4
Fig. 5
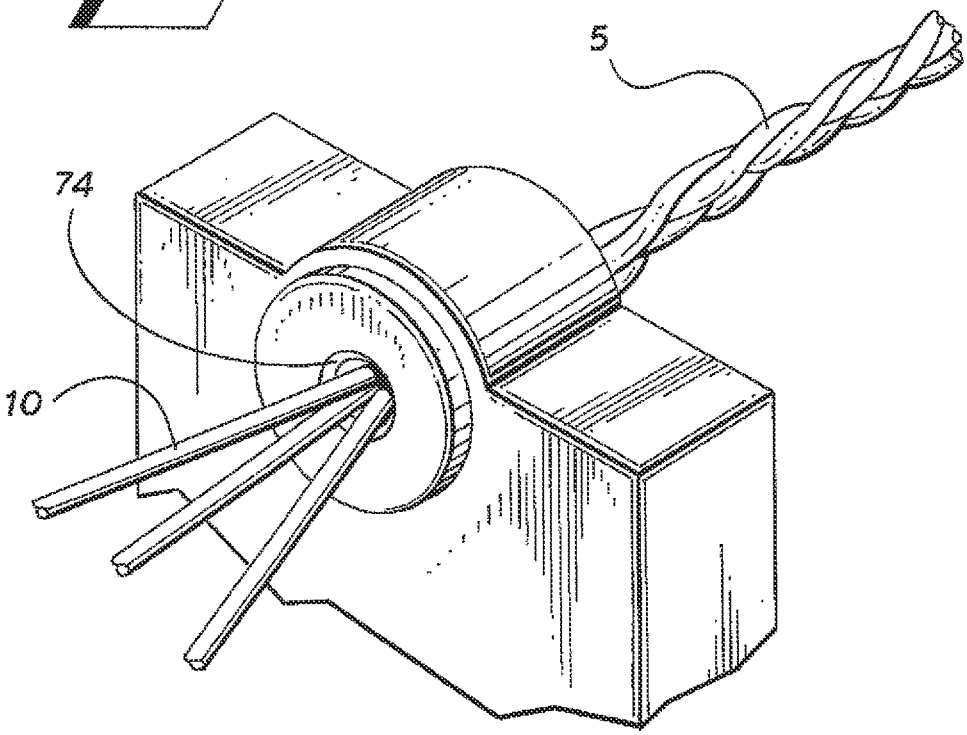

METHOD OF PRODUCING A MULTI-ELEMENT ASSEMBLY

RELATED APPLICATIONS

This application is a divisional of U.S. application Ser. No. 11/853,429 entitled "Multi-Element Twisted Assembly and Method Using Reverse Axial Torsion" filed Sep. 11, 2007 claims the benefit under provisions of 35 U.S.C. §119(e) of U.S. Provisional Application No. 60/825,319 filed Sep. 12, 2006, which are incorporated herein by reference.

BACKGROUND

The present invention relates to the twisting of individual elements of material utilizing "reverse axial torsion" and "reverse axial twist", for a tight binding of twisted elements in a multi-element assembly.

One need for twisted multi-element assemblies is in the area of twisted cables, including, but not limited to, insulated conductors. One example of conventional twisting of multiple insulated conductors includes planetary cabling equipment such as drum twisters with rotating payoffs or bowplexers. Planetary assembly methods do not impart axial twist and a conductor remains essentially "straight" without torsion forces acting to hold the assembly together. Another example of twisting of multiple insulated conductors includes non-planetary assembly methods. Typical equipment for a non-planetary assembly are rotating drum twisters with stationary payoffs and single or double twist bunchers with stationary payoffs. Non-planetary cabling imparts an axial twist along each conductor in the same direction as the assembly twist or helix direction. The imparting of axial twists along each conductor in the same direction, however, results in torsion imparted on the individual conductors that causes the assembly to open up. As a result, the multi-element twisted assembly does not stay together as desired. Specifically with respect to utility power cables, a "loose" multi-element assembly impedes the ability to push the multi-element assembly into a conduit.

Accordingly, there is a need for more tightly bound multi-element twisted assemblies including cable elements, as well as generally in other individual elements in a variety of other applications.

SUMMARY

To answer this need, the present invention provides a multi-element twisted assembly comprising a plurality of twisted elastic elements wherein each element is twisted about its axis in an opposite direction from an axially twist direction of the multi-element twisted assembly, and wherein the plurality of twisted elastic elements impart reverse axial torsion force to tightly maintain the multi-element twisted assembly.

In one embodiment, the elements are insulated conductors. Exemplary insulated conductors include, but are not limited to, low/medium/high voltage cables, 600V power cables, data cables, coaxial cables, telephone cables, low voltage electrical cables, and the like. Examples of material providing insulation in the conductor includes material of rubber, polyethylene, polyvinyl chloride, chlorosulfonated polyethylene, polypropylene, fiberglass, chloropolyethylene, polychlorprene, neoprene, vinyl and silane-crosslinked polyethylene. Combinations of these and other materials, including plastics, polymers, synthetic and natural materials conducive to reverse axial torsion may also be used in embodiments of the invention.

In some embodiments, an insulated conductor includes a bare wire conductor core, including twisted aluminum or copper wires or untwisted, solid conductor cores. In embodiments of the invention, an insulated conductor may also comprise a plurality of insulated conductors in a jacket, including Romex brand wire of Southwire Company (Carrollton, Ga.).

In other embodiments of the invention, elements of the present invention may include, but are not limited to, bare wire conductors and other solid form elements. In other embodiments, individual elements may include tubular materials, such as tubing, hoses and fiber optic cables and the like. In addition to bare metal wires, twistable materials conducive to reverse axial torsion may include, but are not limited to, rubber, polyethylene, polyvinyl chloride, chlorosulfonated polyethylene, polypropylene, fiberglass, chloropolyethylene, polychlorprene, neoprene, vinyl and crosslinked polyethylene. Combinations of these and other materials, including twistable plastics, twistable polymers, twistable synthetic and twistable natural materials may also be used in embodiments of the invention.

To create a tightly bound multi-element assembly in embodiments of the invention, a reverse axial twist is imparted on each element of a plurality of elements to bind the plurality of elements together. The twisting of individual elements and the collective twisting of the multi-element assembly may be performed manually by individuals or automatically with machinery to twist each element about its axis in an opposite direction from an axially twist direction of the multi-element twisted assembly. The plurality of twisted elastic elements impart reverse axial torsion force to produce a tightly bound multi-element twisted assembly.

In some embodiments of the invention, elements, such as wires, cables, tubing, hoses, and other materials capable of winding on a reel, are bound together by rotating a plurality of payoffs about their respective axes to twist a element from each payoff, passing the elements through a die, rotating a take-up about its axis slower than the payoffs, and collecting the multi-element assembly of the plurality of elements on the take-up. In further embodiments a lay plate may be used with the die, such as in a die station to bring the individual elements together into the multi-element assembly. The slower rotation of the take-up and collective multi-element assembly versus the faster twisting of individual elements results in reverse axial torsion in the assembly among the elements to produce a tightly bound assembly.

In further embodiments, the payoffs are rotated about their axis from 5% to 35% faster than the take-up rotation.

In other embodiments, the elements are each paid off from a reel in a payoff that is rotating about its axis (i.e. end-over-end), each element is twisted in a payoff capstan rotating about its axis; the elements are passed through a die; a take-up is rotated about its axis (i.e. end-over-end) slower than each payoff capstan; and the multi-element assembly of the plurality of elements is collected on the take-up. In a further embodiment, a take-up capstan conveying the multi-element assembly between the die and take-up is rotated about its axis slower than each payoff capstan. In certain embodiments the payoff capstan is rotated from 5% to 35% faster than the take-up capstan and take-up.

In another embodiment of the invention, a bare wire conductor may be extruded with an insulating jacket while assembled into a multi-element assembly imparted with reverse axial torsion. In one embodiment of extrusion and assembly, a plurality of payoffs are rotated about their respective axes to twist a element of bare wire conductor from each payoff, an insulating jacket is extruded onto each bare wire conductor; the extruded elements are passed through a die or die station. A take-up is rotated about its axis slower than the payoffs and the multi-element assembly of the plurality of elements including reverse axial torsion is collected on the take-up. In one such embodiment, the payoffs are rotated from 5% to 35% faster than the take-up.

BRIEF DESCRIPTION OF THE DRAWINGS

FIG. 1 is a top plan view of an assembly of three insulated conductors imparted with reverse axial torsion in an embodiment of the present invention.

FIG. 4 is a perspective view from above of a plurality of elements twisted together through a lay plate and die in an embodiment of the present invention.

FIG. 5 is a perspective view from above depicting individual elements brought together through a die to produce a multi-element assembly in an embodiment of the present invention.

FIG. 7 is a basic schematic diagram of a payoff in an embodiment of the present invention.

DETAILED DESCRIPTION

Figure 2:
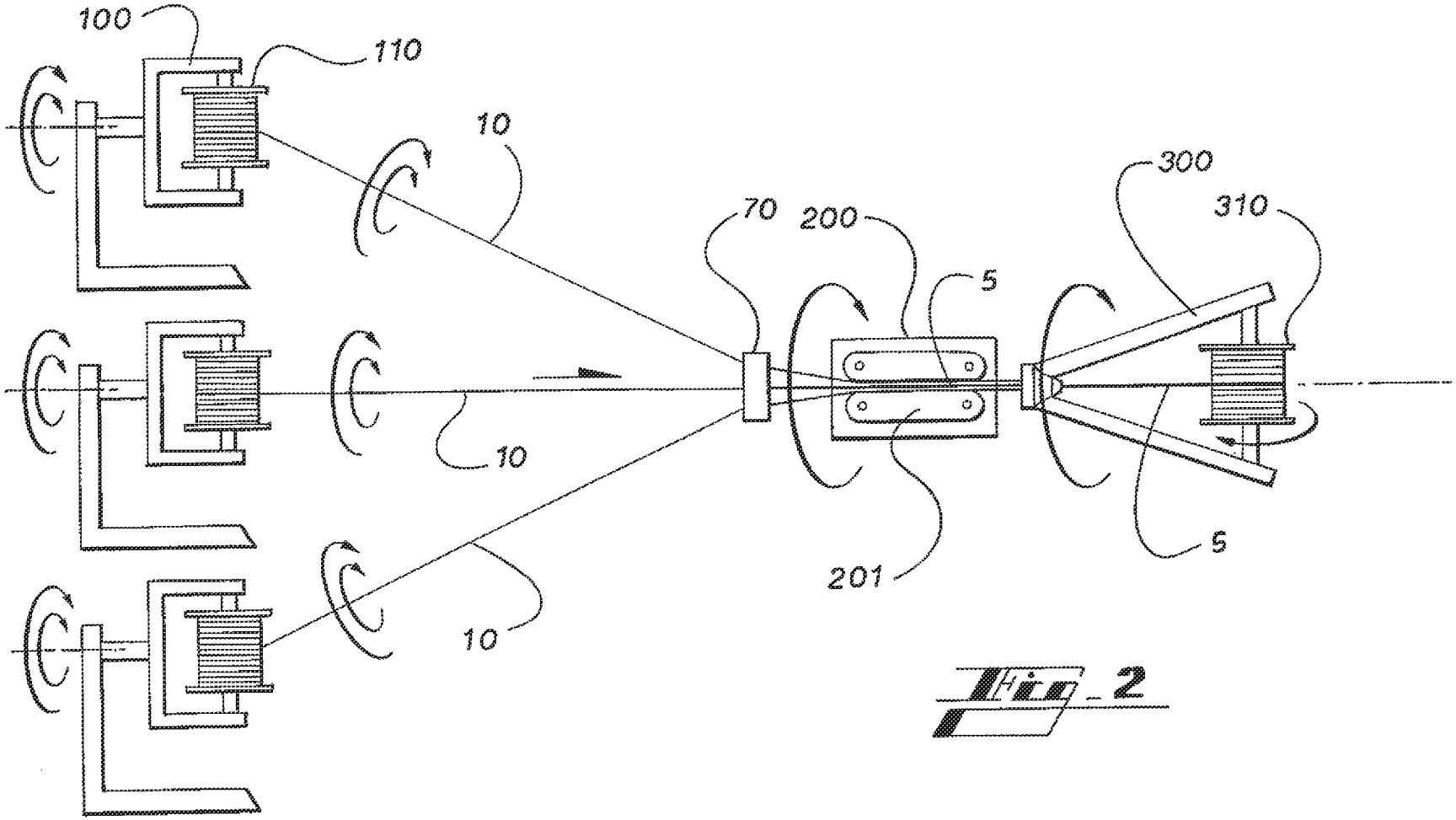
FIG. 2 is a basic schematic diagram illustrating imparting reverse axial torsion to the elements of a multi-element assembly with rotating payoffs, a rotating assembly pull-out capstan and rotating take-up in an embodiment of the present invention.

Embodiments of the invention will be described with reference to the accompanying drawings and figures wherein like numbers represent like elements throughout. Further, it is to be understood that the phraseology and terminology used herein is for the purpose of description and should not be regarded as limiting. The use of "including", "comprising", or "having" and variations thereof herein is meant to encompass the items listed thereafter and equivalents thereof as well as additional items. The terms "mounted", "connected", "bound" and "coupled" are used broadly and encompass both direct and indirect mounting, connecting, binding and coupling. Further, "connected", "bound" and "coupled" are not restricted to physical or mechanical connections, bindings or couplings.

While embodiments of the invention are described with respect to elements of cable, and insulated cables, it will be appreciated that the invention encompasses a wide variety of multi-element assemblies, including low/medium/high voltage cables, 600V power cables, data cables, coaxial cables, telephone cables, low voltage electrical cables, bare wire conductors, wire rope, tubing, hoses, fiber optic cables, combinations thereof, and other applications. In some embodiments, an insulated conductor includes a bare wire conductor core, including twisted aluminum or copper wires. In other embodiment a solid conductor core with twisted wires may be used. In further embodiments of the invention, the insulated conductor comprises an outer jacket with a plurality of individually insulated conductors jacketed therein, and optionally with a combination of one or more bare wire conductors, including Romex brand wire of Southwire Company (Carrollton, Ga.).

In insulated or jacketed elements, such as in insulated conductors, jacket material providing insulation in the conductor includes, but is not limited to, material of rubber, polyethylene, polyvinyl chloride, chlorosulfonated polyethylene, polypropylene, fiberglass, chloropolyethylene, polychlorprene, neoprene, vinyl and crosslinked polyethylene. Combinations of these and other materials, including plastics (thermoset and thermoplastic), polymers (cross-linked and non-cross-linked), synthetic and natural materials conducive to reverse axial torsion may also be used in embodiments of the invention.

In other embodiments of the invention, elements of the present invention may include, but are not limited to, bare wire conductors and other solid form elements. In other embodiments, individual elements may include tubular materials, such as tubing, hoses and fiber optic cables and the like In addition to metal wires, twistable materials conducive to reverse axial torsion may include, but are not limited to, rubber, polyethylene, polyvinyl chloride, chlorosulfonated polyethylene, polypropylene, fiberglass, chloropolyethylene, polychlorprene, neoprene, vinyl and silane-crosslinked polyethylene. Combinations of these and other materials, including twistable plastics (thermoset and thermoplastic), twistable polymers (cross-linked and non-cross-linked), twistable synthetic and twistable natural materials may also be used in embodiments of the invention.

Further, in embodiments of the invention, elements may include bare wire, elastic material, jackets, insulation material, coatings, synthetic and natural materials capable of twisting and storing torsion energy like a torsion spring. As used herein, the term "elastic" means that a twisted element tends toward returning to its initial untwisted form. As used herein, the term "reverse axial twist" means in a twisted (or helical) multi-element assembly that each individual element in the assembly is twisted along its axis in a direction that is opposite from the direction of twist or helix direction of the collective assembly. As used herein, the term "reverse axial torsion force" means the spring-like untwisting force of twisted elements in a twisted multi-element assembly in which the elements have a reverse axial twist.

Referring now to FIG. 1, in an embodiment of the present invention a multi-element 600V UD power cable assembly 5 of insulated conductors is shown. The multi-element assembly 5 includes three elements 10 twisted together and held together with reverse axial torsion. As illustrated by striped element 20, each element includes a reverse axial twist, such that each element is twisted along its axis in a direction that is opposite from the direction of the twist or helix direction of the cable assembly 5. Where the elements 10 include elastic material, the reverse axial twist in the individual elements with respect to the assembly 5 provides reverse axial torsion to maintain the multi-element assembly in a tightly bound configuration. In depicted embodiments, a multi-element assembly 5 includes three elements; however, a plurality of other numbers of individual elements may be used without departing from the present invention.

A multi-element assembly 5 as shown in FIG. 1, may be constructed by manual twisting of individual elements and 10 the collective assembly 5 to provide reverse axial torsion. In other embodiments, as subsequently described, a multi-element assembly, with reverse axial torsion may be formed automatically with machinery.

FIG. 2 illustrates the imparting of reverse axial torsion in a multi-element assembly 5 with rotating payoffs 100, a rotating pull-out assembly capstan 200 and a rotating take-up 300. In a depicted embodiment, each element 10 is unwound from a payoff reel 110 that is mounted on a payoff 100. Each payoff 100 rotates the payoff reel 110 end-over-end, such as in a clockwise direction. Double arrows designate general faster rotation than single arrows, but do not reflect any specific ratio of speed. With further reference to FIG. 4, each rotating element 10 is pulled through a lay plate and die station 70 for twisting into a multi-element assembly 5.

With further reference to FIGS. 4 and 5, at the lay plate and die station 70, each rotating individual element 10 passes through a respective opening in the lay plate 72 and into an opening of die 74. At die 74, the elements 10 are twisted together to form multi-element assembly 5.

Referring again to FIG. 2, following the lay plate and die station 70, the multi-element assembly 5 is conducted through a rotating pull-out capstan 200. The rotating assembly capstan 200 rotates end-over-end in the same direction as the payoffs 100, but at a slower speed. In embodiments of the invention, the payoffs 10 are rotated from 5% to 35% faster than the rotating assembly pull-out capstan 200.

The multi-element assembly 5 is conducted in conveyors 201 of the rotating assembly capstan 200 to rotating take-up 300 that includes take-up reel 310.

The take-up 300 also rotates end-over-end at the same speed and in the same direction as assembly capstan 200, but at a slower speed than the payoffs 100, like assembly capstan 200. The multi-element assembly 5 is simultaneously wound on to take-up reel 310 as the take-up 300 rotates the take-up reel 310 end-over-end. The slower rotation of the take-up 300 and assembly capstan 200 with respect to payoffs 100, results in reverse axial twist in the faster rotating stands 10 versus the slower rotation of the multi-element assembly 5. Referring again to FIG. 1, the multi-element assembly 5 thus includes an axial twist direction opposite from the twist direction of each of elements 10.

Figure 3:
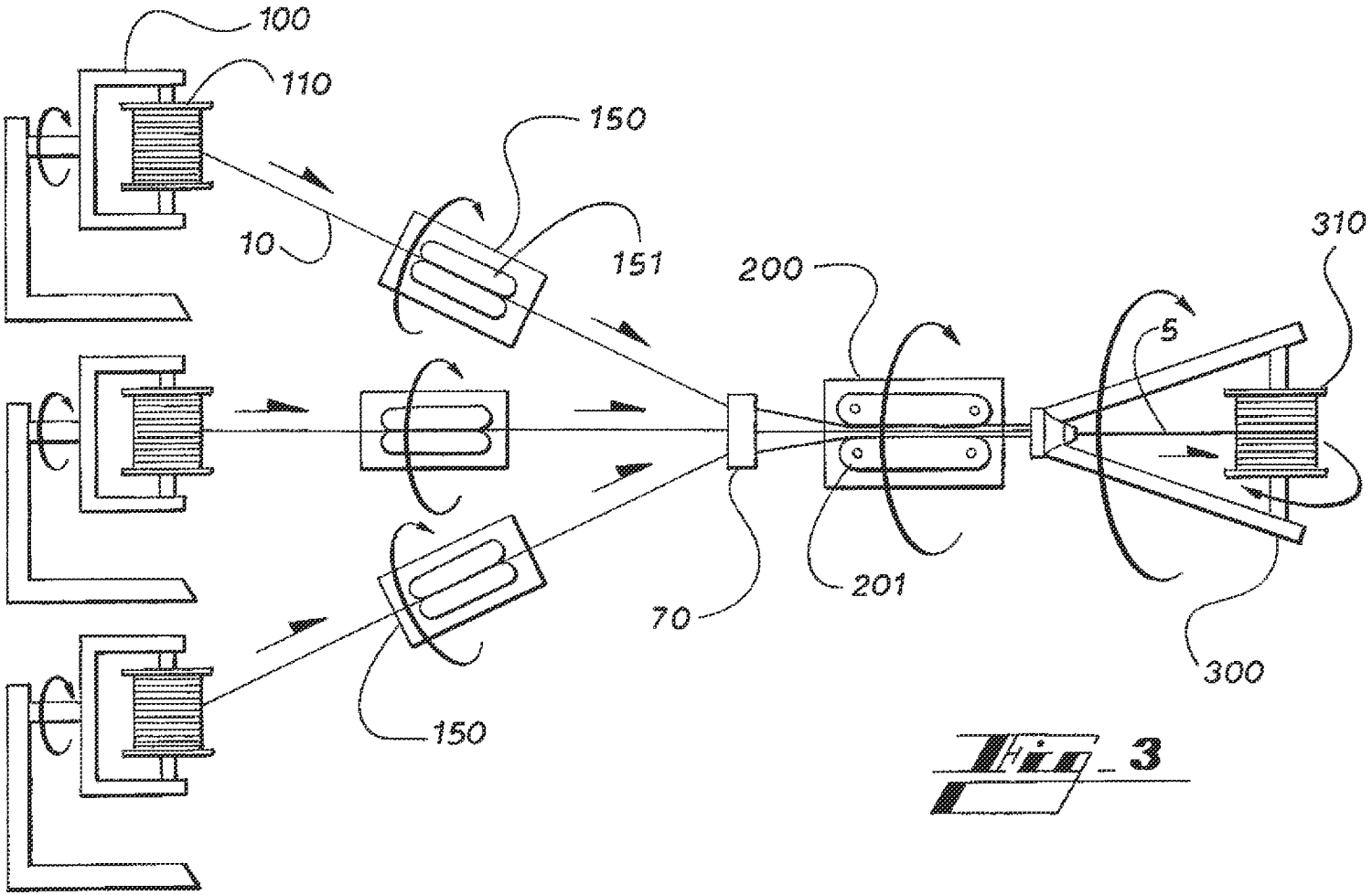
FIG. 3 is a basic schematic diagram illustrating imparting of reverse axial torsion to produce a multi-element assembly with rotating payoffs, rotating element pull-out capstans, a rotating assembly pull-out capstan and a rotating take-up in an embodiment of the present invention.

An alternative embodiment for producing a multi-element assembly 5 with reverse axial twist in elements 10 and reverse axial torsion in the assembly 5 is shown in FIG. 3. In the depicted embodiment, individual elements 10 are unwound from a rotating payoff reel 110 from each of payoffs 100. As in FIG. 2, elements 10 pass through a lay plate and die station 70 and are twisted into a multi-element assembly 5. The assembly 5 passes through rotating assembly pull-out capstan 200 and wound on to take-up reel 310 mounted in rotating take-up 300. However, before each element reaches the lay plate and die station 70, it is pulled through an element pull-out capstan 150 that includes a conveyor 151. Each rotating element pull-out capstan 150 rotates faster than the assembly capstan 200 and take-up 300. In embodiments of the invention, element capstans 150 rotate 5% to 35% faster than the take-up 300 and assembly capstan 200. As each element passes through the faster rotating element capstan 150 reverse axial twist is imparted onto each element 10. A multi-element assembly 5 results as shown in FIG. 1. In other embodiments of the invention, a combination of rotating end-over-end payoffs 100 may be used for unwinding some elements 10, while payoffs 100 with rotating element capstans 150 (FIG. 3) are used with other elements 10.

Figure 6:
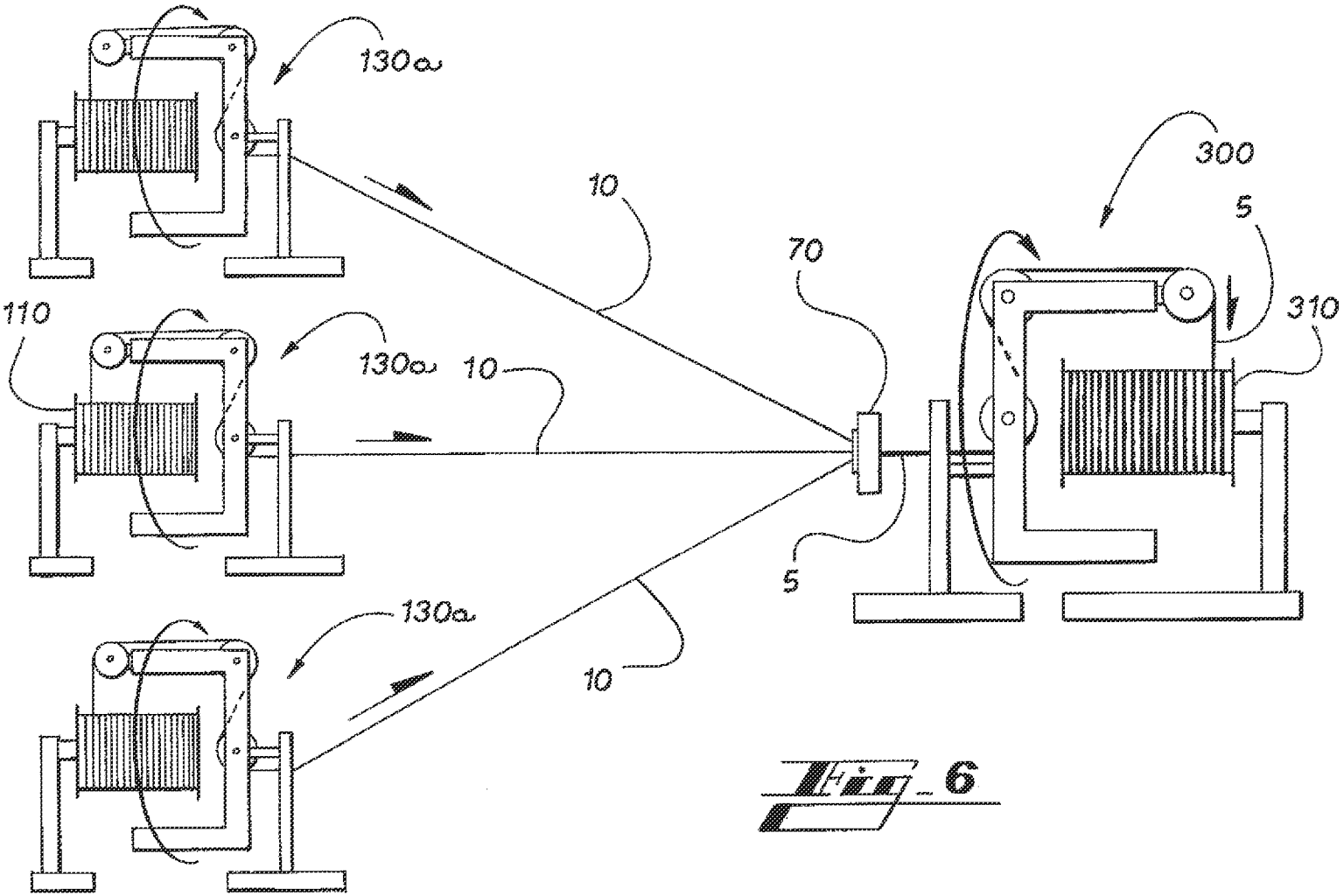
FIG. 6 is a basic schematic diagram illustrating single twist cablers as rotating payoffs and rotating single twist cablers as take-ups to impart reverse axial torsion in a plurality of elements to produce a multi-element assembly in an embodiment of the present invention.

In other embodiments of the invention, such as shown in FIG. 6, a multi-element assembly 5 may be produced without rotating capstans. In FIG. 6, single twist cablers 130 are used as payoffs and take-ups. In other embodiments, double twist cablers may also be used. With continuing reference to FIG. 6 and further reference to FIG. 7, a single twist cabler 130A acts as a rotating payoff to receive a element 10 unwound from reel 110. In each single twist cabler 130A acting as a payoff, element 10 passes through a series of element guide wheels 107 that allow element 10 to be twisted about its axis as single twist cabler 130A acts as a rotating payoff rotates end-over-end. Unlike in FIG. 2, payoff reels 110 are not rotated end-over-end, but element 10 passing through the element guide wheels 107 of single twist cabler 130A and is twisted about its axis as the single twist cabler 130A and wheels 107 are rotated end-over-end. From each single twist cabler 130A, each of elements 10 pass through a lay plate and die station 70 for twisting into multi-element assembly 5. A single twist cabler 130B acts as a take-up, rotates end-over-end to twist multi-element assembly 5. Multi-element assembly 5 passes through guide wheels of rotating single twist cabler 130B that rotates slower than single twist cablers 130A. In embodiments of the invention, the single twist cablers 130A acting as payoffs rotate from 5% to 35% faster than the take-up. The multi-element assembly 5 imparted with reverse axial torsion is wound onto take-up reel 310.

It will be appreciated that where individual elements 10 are rotated about their axis faster than the multi-element assembly 5 is rotated about its axis on the other side of the lay plate and die station, the same direction of rotation may be clockwise or counter-clockwise. Further, it will be appreciated that depending on the materials and purposes of twisted assembly the differences in rotation speed to produce reverse axial twist may vary from specified ranges of described embodiments. Generally, where speed differences are low or slower "looser" elements will result, and at higher or faster speed differences a more twisted element will result, including a "corkscrew effect" in very tight assemblies.

Figure 8:
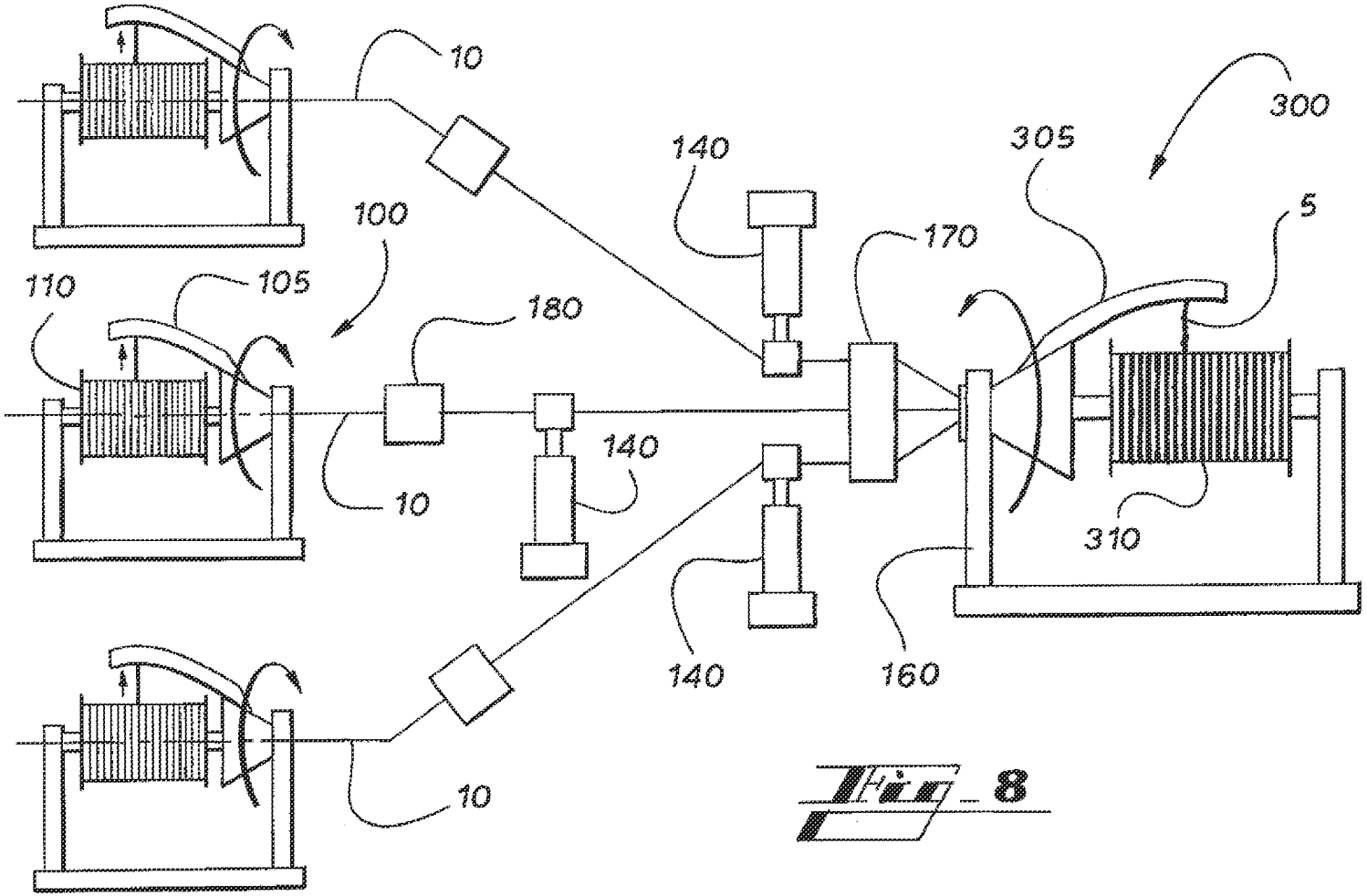
FIG. 8 is a basic schematic diagram depicting bare conductor elements being insulated by extruders while reverse axial torsion is imparted to the elements to produce a multi-element assembly of insulated elements in an embodiment of the present invention.

Referring to FIG. 8 and incorporating herein by reference U.S. Pat. No. 6,526,738, in another embodiment of the invention, a bare wire conductor may be extruded with an insulating jacket while assembled into a multi-element assembly 5 imparted with reverse axial torsion. Wire elements 10 are unwound from payoff reel 110 in a rotating end-over-end flyer 105. The elements 10 are twisted about their axis and pass through accumulator and metering capstans 180. At extruder 140 material is extruded onto each element and the extruded rotating elements 10 pass through accumulator and pull-out capstan 170 and through single twist cabler 160. The insulated conductor elements are twisted together as take-up flyer 305 rotates end-over-end at take-up 300. The multi-element assembly 5 of insulated conductors is wound onto take-up reel 310. In embodiments of the invention, the payoff flyers 105 rotate from 5% to 35% faster than the take-up flyer 305. Accordingly, the individual extruded elements 10 include a reverse axial twist and reverse axial torsion is imparted in the multi-element assembly 5.

Although the invention herein has been described with reference to particular embodiments, it is to be understood that these embodiments are merely illustrative of the principals and applications of the present invention. Accordingly, while the invention has been described with reference to the structures and processes disclosed, it is not confined to the details set forth, but is intended to cover such modifications or changes as may fall within the scope of the following claims.

What is claimed is:

1. A method for producing a multi-element assembly, the method comprising imparting a reverse axial twist on each element of a plurality of elements to bind the plurality of elements together in the multi-element assembly, wherein imparting the reverse axial twist comprises;

rotating a plurality of payoffs about their respective axes to twist respective ones of the plurality of elements fed from each of the plurality of payoffs;

passing the plurality of elements through a die;

rotating a take-up about an axis perpendicular to a direction of travel of the plurality of elements slower than the plurality of payoffs; and collecting the multi-element assembly of the plurality of elements on the take-up.

2. The method of claim 1, wherein each of the plurality of elements comprises an insulated conductor.

3. The method of claim 1, wherein each of the plurality of elements is selected from the group consisting of a 600V power cable, a data cable, a coaxial cable, a telephone cable, and a low voltage electrical cable.

4. The method of claim 1, further comprising rotating the plurality of payoffs from 5% to 35% faster than the take-up.

5. The method of claim 1, wherein each of the plurality of elements comprises at least one elastic material selected from the group consisting of rubber, polyethylene, polyvinyl chloride, chlorosulfonated polyethylene, polypropylene, fiberglass, chloropolyethylene, polychlorprene, neoprene, vinyl, and silane-crosslinked polyethylene.

6. A method for producing a multi-element assembly, the method comprising:

feeding a plurality of elements, from a respective plurality of payoffs, through a die to form the multi-element assembly, wherein feeding the plurality of elements comprises rotating each of the plurality of plurality of payoffs in a first direction at approximately a first speed to respectively twist each of the plurality of elements; and collecting the multi-element assembly from the die on a take-up, wherein collecting the multi-element assembly comprises rotating the take-up in the first direction at approximately a second speed wherein the second speed is slower than the first speed.

7. The method of claim 6, wherein rotating the take-up in the first direction at approximately the second speed wherein the second speed is slower than the first speed comprises rotating the take-up in the first direction at approximately the second speed wherein the first speed is 5% to 35% faster than the second speed.

8. The method of claim 6, wherein rotating the take-up in the first direction at approximately the second speed wherein the second speed is slower than the first speed comprises rotating the take-up in the first direction at approximately the second speed wherein the first speed is 10% to 25% faster than the second speed.

9. The method of claim 6, wherein rotating the take-up in the first direction at approximately the second speed wherein the second speed is slower than the first speed comprises rotating the take-up in the first direction at approximately the second speed wherein the first speed is 15% to 20% faster than the second speed.

10. The method of claim 6, wherein rotating each of the plurality of plurality of payoffs comprises rotating end-over-end each of the plurality of plurality of payoffs comprising payoff reels.

11. The method of claim 6, wherein rotating the take-up comprises rotating end-over-end the take-up comprising a take-up reel.

12. The method of claim 6, wherein collecting the multi-element assembly comprises rotating the take-up wherein the second speed is slower than the first speed to impart a reverse axial twist on each of the plurality of elements to bind the plurality of elements together in the multi-element assembly.

13. The method of claim 6, wherein feeding the plurality of elements comprises feeding the plurality of elements wherein each element of the plurality of elements comprises an insulated electrical conductor.

14. The method of claim 6, wherein feeding the plurality of elements, from the respective plurality of payoffs, through the die to form the multi-element assembly comprises feeding the plurality of elements, from the respective plurality of payoffs, through the die to form the multi-element assembly comprising a 600 V UD power cable.

15. The method of claim 6, wherein feeding the plurality of elements comprises feeding the plurality of elements wherein each the plurality of elements comprises one of the following: a 600V power cable, a data cable, a coaxial cable, a telephone cable, a low voltage electrical cable, a flexible tube, a hose, and a fiber optic cable.

16. The method of claim 6, further comprising rotating an assembly pull-out capstan, to convey the multi-element assembly between the die and the take-up, about the assembly pull-out capstan's axis slower than the first speed.

17. A method for producing a power cable, the method comprising:

feeding a plurality of elements from a respective plurality of payoffs through a die to form the power cable, wherein feeding the plurality of elements comprises rotating each of the plurality of payoffs in a first direction at a first speed to respectively twist each of the plurality of elements wherein rotating each of the plurality of payoffs comprises rotating end-over-end each of the plurality of payoffs comprising payoff reels wherein each element of the plurality of elements comprises an insulated electrical conductor;

rotating an assembly pull-out capstan, to convey the power cable between the die and the take-up, about the assembly pull-out capstan's axis slower than the first speed; and collecting the power cable from the die on a take-up, wherein collecting the power cable comprises rotating the take-up in the first direction at a second speed wherein the second speed is slower than the first speed wherein the first speed is 5% to 35% faster than the second speed wherein rotating the take-up comprises rotating end-over-end the take-up comprising a take-up reel, wherein the second speed is slower than the first speed to impart a reverse axial twist on each of the plurality of elements to bind the plurality of elements together in the power cable.

* * * * *